US006173589B1

(12) United States Patent
Hayes, Jr. et al.

(10) Patent No.: US 6,173,589 B1
(45) Date of Patent: Jan. 16, 2001

(54) KNITTED FOOT COVER AND METHOD OF MANUFACTURE

(75) Inventors: Teddy B. Hayes, Jr., Wadesboro; Samuel Kaplan, Charlotte, both of NC (US)

(73) Assignee: Highland Mills, Inc., Charlotte, NC (US)

( * ) Notice: Under 35 U.S.C. 154(b), the term of this patent shall be extended for 0 days.

(21) Appl. No.: 09/415,872

(22) Filed: Oct. 8, 1999

(51) Int. Cl.[7] ..... A41D 27/24; A41D 1/22; A41D 13/06

(52) U.S. Cl. ..... 66/171; 66/177; 2/239

(58) Field of Search ..... 66/171, 177, 202; 2/239

(56) References Cited

U.S. PATENT DOCUMENTS

| | | | | |
|---|---|---|---|---|
| Re. 26,667 | | 9/1969 | Sarbo . | |
| 3,241,340 | * | 3/1966 | Knohl | 66/177 |
| 3,600,909 | | 8/1971 | Kaplan . | |
| 3,733,860 | | 5/1973 | Engelhard . | |
| 4,663,946 | * | 5/1987 | Wright | 66/177 |
| 5,020,164 | * | 6/1991 | Edwards | 2/239 |
| 5,784,721 | * | 7/1998 | Huff | 2/239 |

* cited by examiner

*Primary Examiner*—Andy Falik
(74) *Attorney, Agent, or Firm*—Adams, Schwartz & Evans, P.A.

(57) ABSTRACT

A tubular knitted body portion, first and second opposed band portions, each of the first and second band portions formed from a segment of respective tubular knitted band portions containing at least some elastic yarns. First and second seams close respective edges of the first and second opposed band portions to each other to define a single band having an elongated shape for being fitted in a stretched condition onto and hugging only the lower portion of the foot with the joined first and second bands positioned on the asymmetrical portion of the foot below the ankle. One of the seams extends along the top of the foot in substantial alignment with the longitudinal axis of the toes. The other of the seams extends along the back of the heel substantially along the longitudinal axis of the Achilles tendon.

14 Claims, 4 Drawing Sheets

KNITTED FOOT COVER AND METHOD OF MANUFACTURE

TECHNICAL FIELD AND BACKGROUND OF THE INVENTION

This invention relates to foot covers of the type worn by women and girls under low-cut shoes when not wearing socks, panty hose or individual full length stockings. The foot cover generally lies below the upper perimeter of the shoe and is therefore hidden from view. Such foot covers are made from highly stretchable yarn and are thus sold in a single size, the amount of stretch being sufficient to accommodate all sizes.

Several prior art designs are known. These include styles with are cut and sewn from knitted fabric with sewn-in upper rims. These older styles have the disadvantage of being expensive to manufacture, since they require a significant amount of skilled labor. In addition, the sewn-in rim can burrow into the skin of the foot when worn under a shoe. Other styles include a knitted tubular structure which is symmetrical, and has an integrally-knitted top rim and a symmetrical foot-hugging body portion. The body portion is closed by a long seam along the bottom opposite the rim. See, U.S. Pat. No. RE 26,667 and U.S. Pat. No. 3,600,909.

Known prior art tubular-knitted foot covers thus include a relatively long bottom seam which lies directly beneath the bottom of the foot and may be uncomfortable when the wearer is standing.

The invention according to this application provides a simple knitted structure which can be knitted on conventional knitting machines and converted to a foot cover with minimal labor, and which has a bottom which is completely devoid of any seams.

SUMMARY OF THE INVENTION

Therefore, it is an object of the invention to provide a foot cover which can be knitted on conventional knitting machines.

It is another object of the invention to provide a foot cover which can be manufactured with minimal labor.

It is another object of the invention to provide a foot cover which has a bottom which is completely devoid of seams.

It is another object of the invention to provide a method of manufacturing a foot cover which achieves a product as described above.

These and other objects of the present invention are achieved in the preferred embodiments disclosed below by providing a method of forming a knitted foot cover, comprising the steps of forming a seamless knitted tube having first and second opposed tubular band portions on opposite ends thereof knitted with at least some elastic yarns, and an intermediate tubular body portion integrally-formed with the band portions. The body portion has a first panel extending along the length of the body portion between the first and second band portions having a first predetermined relatively high tension, The body portion also has a second panel extending along the length of the body portion between the first and second band portions having a second predetermined relatively low tension, the relatively different tensions of the first panel and the second panel forming the tube into a curved shape along its longitudinal axis. The method also includes the step of cutting through the first panel and the first and second band portions of the tube along a relatively straight cut line between the first and second band portions to form respective first and second free ends on each of the two band portions, and then joining the first free end of the first band portion and an adjacent length of the first panel to the first free end of the second band and an opposing adjacent length of the first panel, and joining the second free end of the second band portion and an adjacent length of the panel to the second free end of the second band and an opposing adjacent length of the first panel to form a foot cover having an elongated shape for being fitted on and hugging only the lower portion of the foot with the joined first and second bands positioned on the asymmetrical portion of the foot below the ankle.

According to one preferred embodiment of the invention, the first panel comprises between 10 and 30 percent of the circumference of the knitted tube.

According to another preferred embodiment of the invention, the knitted tube is knitted of synthetic yarns.

According to yet another preferred embodiment of the invention, the body portion of the knitted tube is knitted of cotton yarns and the first and second band portions are knitted of elastic yarns.

According to yet another preferred embodiment of the invention, the first and second band portions are knitted of elastic yarns selected from the group consisting of spandex, synthetic latex and rubber.

Preferably, the step of knitting the tube comprises the step of knitting the tube on a circular knitting machine.

Preferably, the step of knitting the tube comprises the step of knitting the tube on a knitting machine having a 4 inch diameter and 400 needles.

According to yet another preferred embodiment of the invention, the step of joining the first and second free ends comprises the step of sewing the free ends together with sewing stitches.

According to yet another preferred embodiment of the invention, the step of the cutting through the first panel and the first and second band portions of the tube comprises cutting with a sharp blade.

According to yet another preferred embodiment of the invention, the step of the cutting through the first panel and the first and second band portions of the tube comprises cutting with a hot wire.

The knitted foot cover according to the invention comprises a tubular knitted body portion, first and second opposed band portions, each of the first and second band portions formed from a segment of respective tubular knitted band portions containing at least some elastic yarns, and first and second seams closing respective edges of the first and second opposed band portions to each other to define a single band having an elongated shape for being fitted in a stretched condition onto and hugging only the lower portion of the foot with the joined first and second bands positioned on the asymmetrical portion of the foot below the ankle, one of the seams extending along the top of the foot in substantial alignment with the longitudinal axis of the toes, and the other of the seams extending along the back of the heel substantially along the longitudinal axis of the Achilles tendon.

According to one preferred embodiment of the invention, the body portion is knitted of synthetic yarns.

According to another preferred embodiment of the invention, the body portion is knitted of cotton yarns.

According to yet another preferred embodiment of the invention, body portion has an elongation of at least 100 percent.

A blank for forming a knitted foot cover comprises a seamless knitted tube having first and second opposed tubular band portions on opposite ends thereof knitted with at least some elastic yarns, an intermediate tubular body portion integrally-formed with the band portions. The body portion has a first panel extending along the length of the body portion between the first and second band portions with a first predetermined relatively high tension. The body portion has a second panel extending along the length of the body portion between the first and second band portions having a second predetermined relatively low tension, the relatively different tensions of the first panel and the second panel forming the tube into a curved shape along its longitudinal axis.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
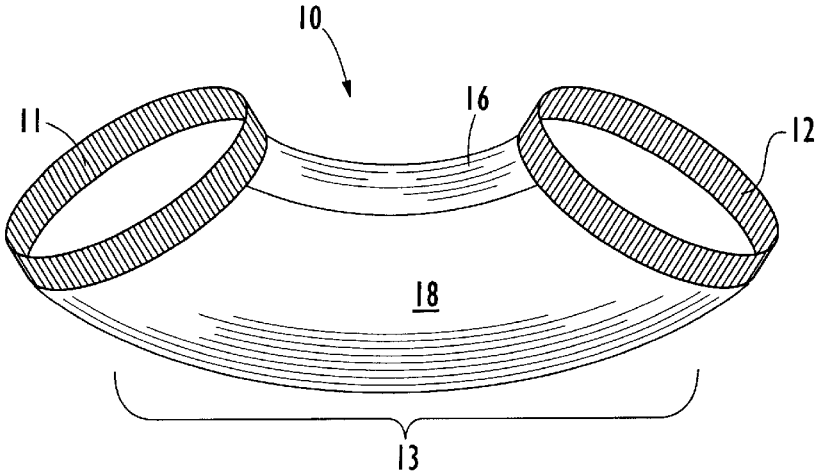
FIG. 1 is a perspective view of a foot cover blank according to one embodiment of the invention.

Referring now specifically to the drawings, a blank for making a foot cover according to the present invention is illustrated in FIG. 1 and shown generally at reference numeral 10. The foot cover blank 10 is a knitted tube, and includes a pair of opposed, integrally-knitted rims or bands 11 and 12 formed on opposite ends of a circular-knitted body portion 13. The body portion defines two panels 16 and 18. Panel 16 is formed of knitting stitches under relatively high tension and thus reduced with reduced elongation in its relaxed state. Panel 16 comprises approximately 15 percent of the circumference of the blank 10, as more specifically described below. Panel 18 defines the other approximately 85 percent of the circumference of the blank 10, and has relatively lower tension and greater elongation in its relaxed state.

As is shown in FIG. 1, this variation in tension between the panel 16 and the panel 18 causes the blank 10 to form a curved, banana-like shape when cast off of the knitting machine. The bands 11 and 12 are knitted with a conventional rib knitting stitch. Preferably, the bands 11 and 12 are knitted at least some elastic yarns, such as spandex yarns. Alternatively, knitted bands with laid-in or plated elastic or synthetic or natural rubber may also be used. The body 13 is knitted with conventional hosiery stitches such as are used on the body portions of panty and other types of hosiery.

Figure 2:
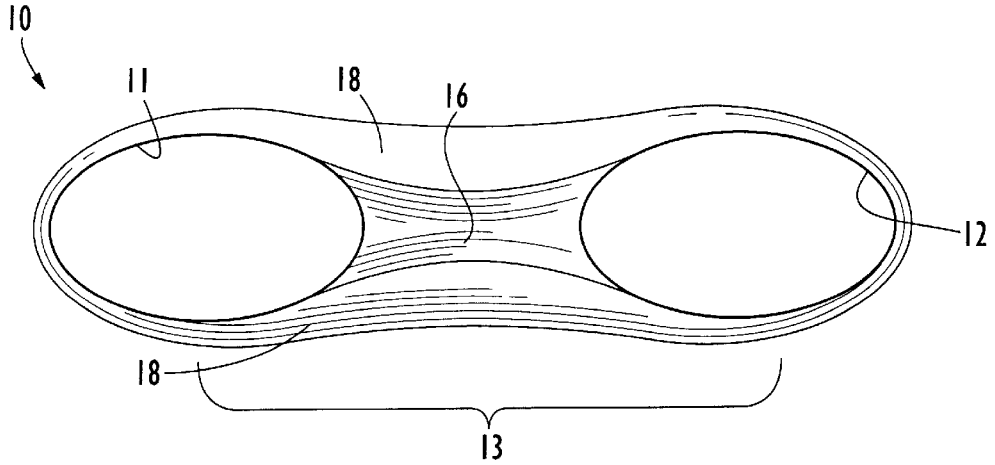
FIG. 2 is a top plan view of the foot cover blank shown in FIG. 1.
Figure 3:
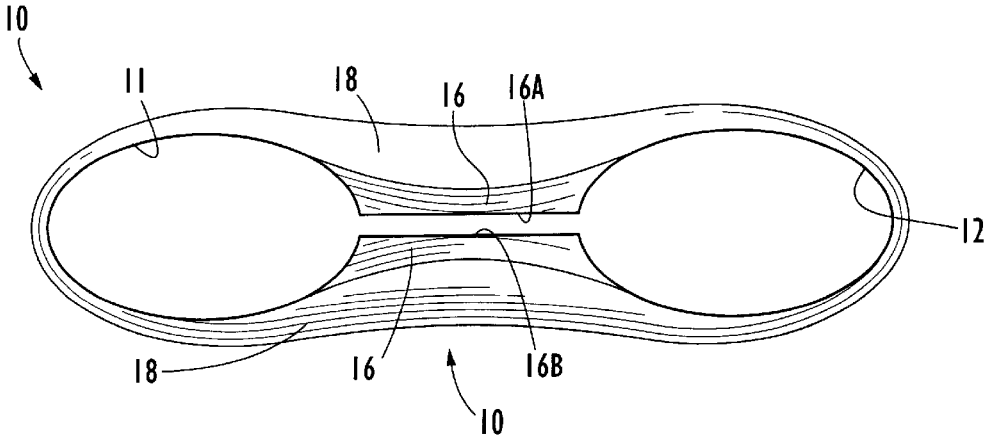
FIG. 3 is a top plan view of the foot cover blank with the relatively high tension panel and bands severed in preparation for forming the foot cover.

As is best shown in FIG. 2, the panel 16 forms a relatively narrow connection between the two bands 11 and 12. This panel 16 forms the means by which the blank 10 is formed into the foot cover. As is shown in FIG. 3, the bands 11 and 12 and the panel 16 are severed with a single, straight cut leaving a pair of opposed, raw, cut edges 16A, 16B. At this point, longitudinal orientation of the blank 10 is changed by 90 degrees. The cut may be made by any suitable sharp blade, or, when the blank 10 is formed of 100 percent synthetic material, by a hot knife in accordance with known practice.

Figure 4:
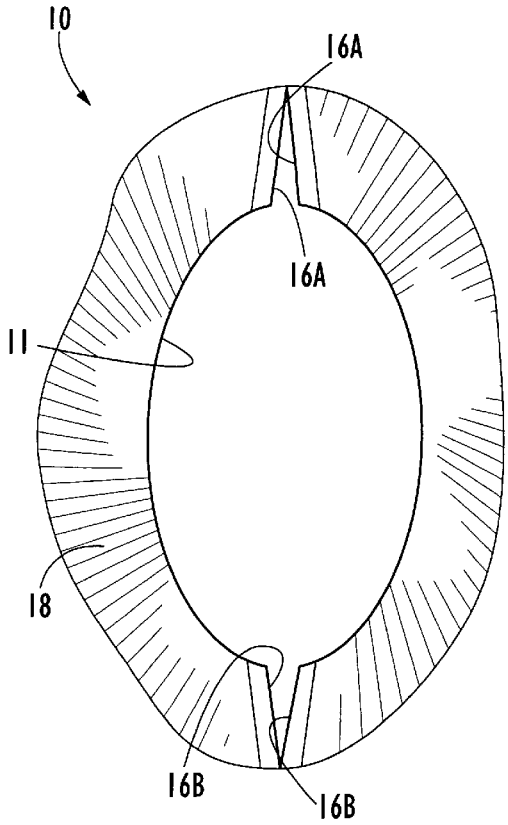
FIG. 4 is a top plan view of the foot cover blank in position to be sewn into the foot cover.
Figure 5:
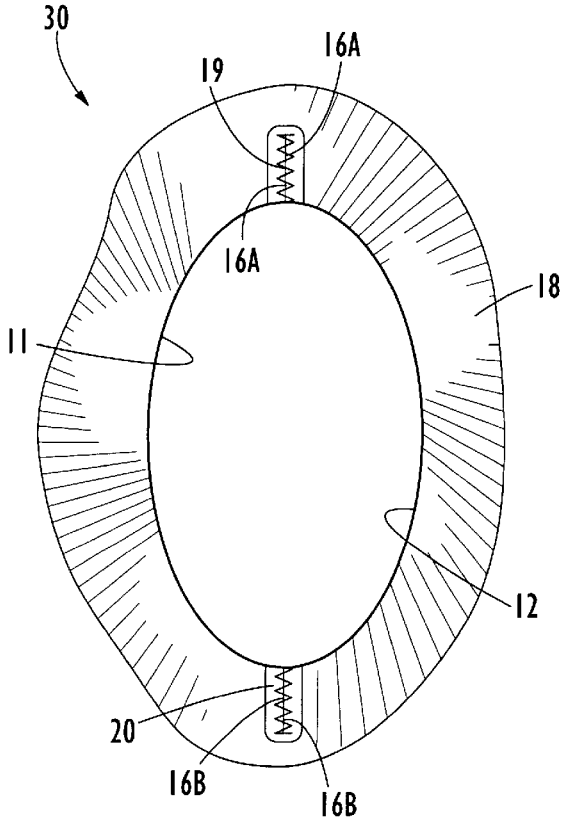
FIG. 5 is a top plan view of the completed foot cover in its relaxed state.
Figure 6:
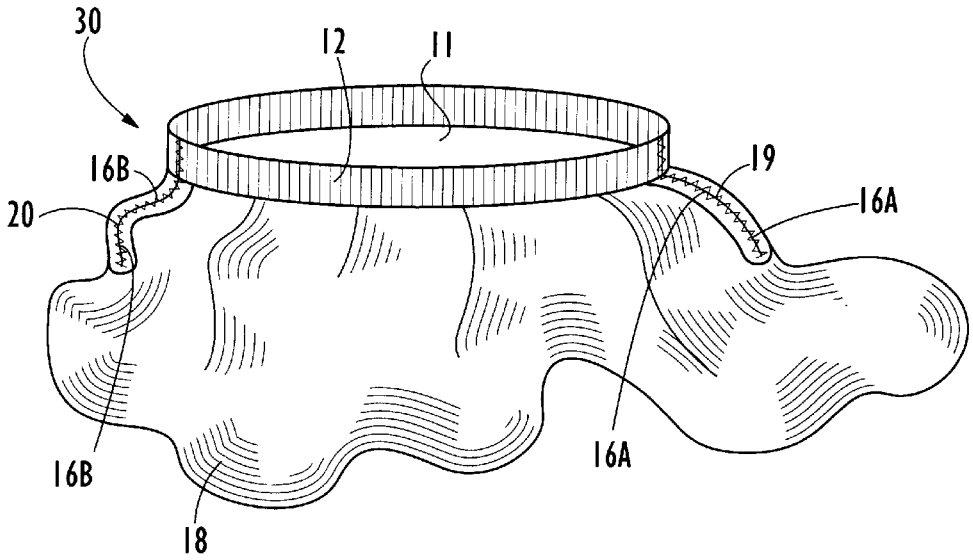
FIG. 6 is a side elevation of the completed foot cover in its relaxed state.

As is shown in FIG. 4, the raw edge 16A is folded onto itself i.e., doubled, to form to adjacent raw edges. Likewise, the raw edge 16B is folded onto itself to form to adjacent raw edges. Note that at this point the two bands 11 and 12 are no longer tubular, but oppose each other in a generally curved configuration. At this point the blank 10 is ready to be sewn. The two opposed edges formed by the doubled seams 16A and 16B are sewn with any conventional sewing stitch, such as a serging stitch, overedge seaming stitch, straight stitch or the like to form seams 19 and 20. The blank 10 is then turned inside-out to place the raw cut edges on the inside, and to expose the smooth, straight side of the seams 19 and 20.

The resulting structure is a foot cover 30, as shown in FIGS. 5–8. In FIGS. 2–5, the outline of the blank 10 is shown relatively evenly to enhance clarity. In reality, in a relaxed condition the foot cover 30 more closely resembles the structure shown in FIG. 6. The uneven, highly irregular shape is characteristic of knitted products having significant elongation. The edges of panel 16 are for the most part enclosed within the seams 19 and 20 and therefore unnoticeable.

Figure 7:
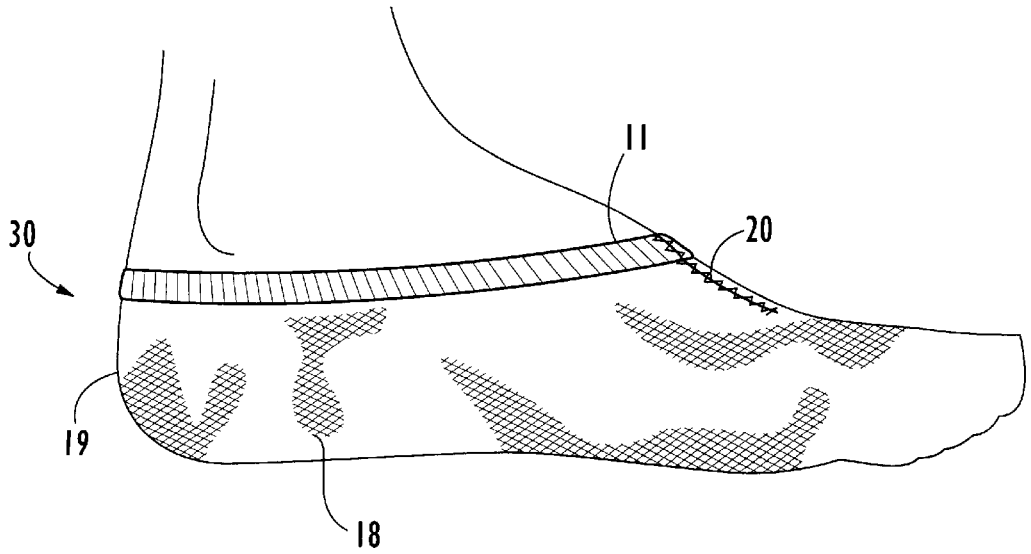
FIG. 7 is a side elevation of the foot cover on a foot.
Figure 8:
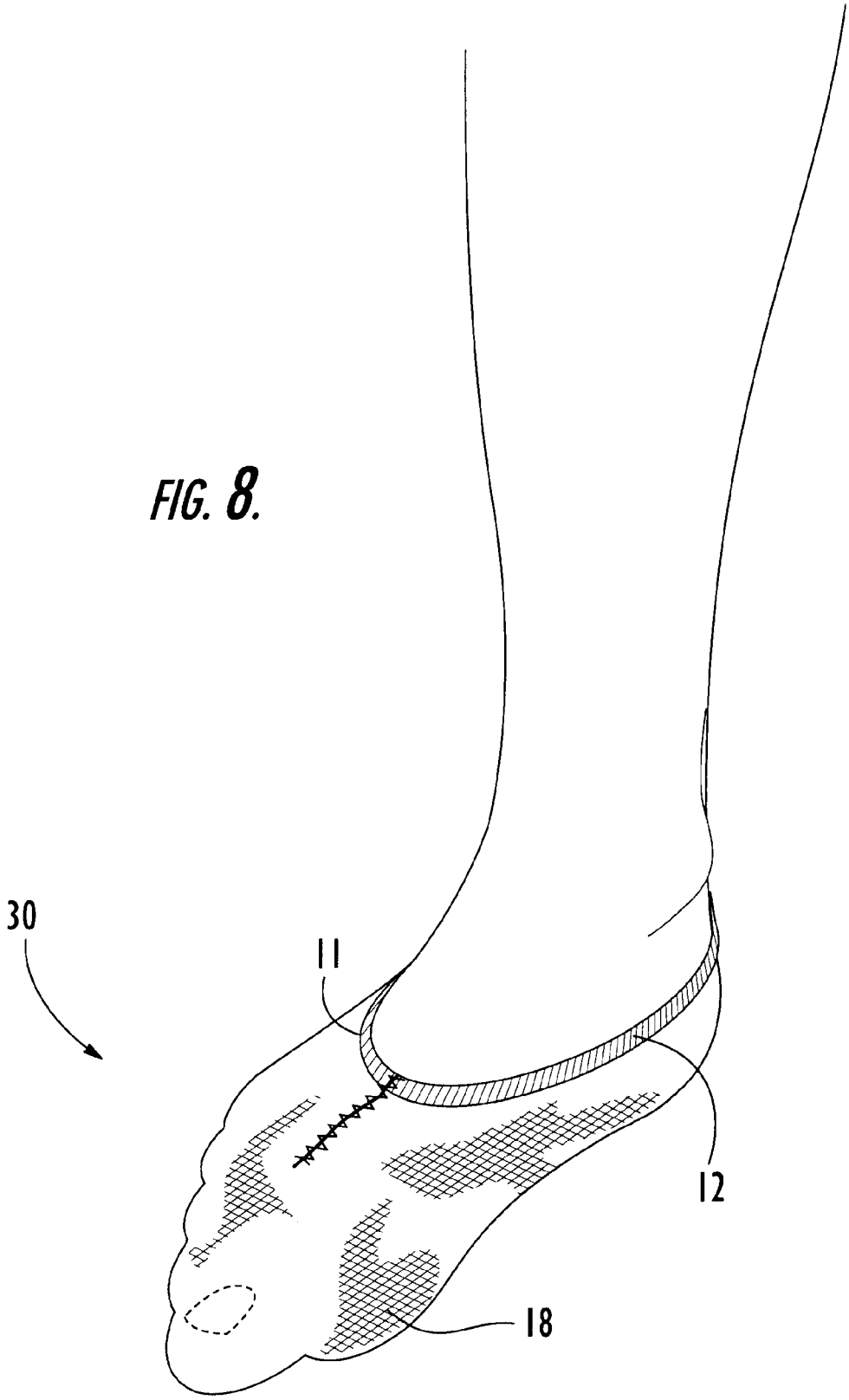
FIG. 8 is a front elevation of the foot cover on a foot.

As is shown in FIGS. 7 and 8, the foot cover has an elongated shape for being fitted in a stretched condition onto and hugging only the lower portion of the foot with the joined first and second bands positioned on the asymmetrical portion of the foot below the ankle.

One of the seams 19 or 20 extends along the top of the foot in substantial alignment with the longitudinal axis of the toes, and the other of the seams 19 or 20 extends along the back or bottom of the heel substantially along the longitudinal axis of the Achilles tendon. The foot cover 30 has no front or back, and can be placed on the foot with either seam 19 or 20 on the front of the foot.

One preferred embodiment of the foot cover blank 10, foot cover 30 according to the method described above can be constructed according to the following specifications:

EXAMPLE

| | | |
|---|---|---|
| Knitting machine | Lonati Model L 404 EJ or L404 | |
| Needles | 400 | |
| Cylinder diameter | 4 inches | |
| Pattern | | |
| Band 11 (120 courses) | Feed No. 1 | 1up/3 down positive |
| | Feed No. 2 | all knit |
| | Feed No. 3 | all knit |
| | Feed No. 4 | all knit |
| Body 13 (400 courses) | Feed No. 1 | positive |
| | Feed No. 2 | positive |
| | Feed No. 3 | positive |
| | Feed No. 4 | positive |
| Thetuck and clearing cams are out on all four feeds. | | |
| Band 12 (125 courses) | Feed No. 1 | 1up/3 down positive |
| | Feed No. 2 | all knit |
| | Feed No. 3 | all knit |
| | Feed No. 4 | all knit |

The extra 5 courses in this band are to permit passing off of the blank form the needles.

The alternating up-and-down needle arrangement in the construction of the panel creates the additional tension necessary to cause the panel 16 to be shorter than the panel 18. As noted above, this causes the blank 10 to assume a curved configuration desirable for completing the construction of the foot cover 30.

The body 13 is formed as follows:

The pattern repeats every 4 courses:

| | | |
|---|---|---|
| Course No. 1 | (panel 18) | Needles 1–112 up |
| | (panel 16) | Needles 113–179 down |
| | (panel 18) | Needles 180–400 up. |
| Course No. 2 | (panel 18) | Needles 1–112 up |
| | (panel 16) | Needles 113–179(1 needle up, 1 needle down) |
| | (panel 18) | Needles 180–400 up. |
| Course No. 3 | (panel 18) | Needles 1–112 up |
| | (panel 16) | Needles 113–179 down |
| | (panel 18) | Needles 180–400 up. |
| Course No. 4 | (panel 18) | Needles 1–112 up |
| | (panel 16) | Needles 113–179 (1 needle down, 1 needle up) |
| | (panel 18) | Needles 180–400 up. |
| Course No. 5 | (panel 18) | Needles 1–112 up |
| | (panel 16) | Needles 113–179 down |
| | (panel 18) | Needles 180–400 up. |
| Course No. 6 | (panel 18) | Needles 1–112 up |
| | (panel 16) | Needles 113–179 (1 needle up, 1 needle down) |
| | (panel 18) | Needles 180–400 up. |
| Course No. 7 | (panel 18) | Needles 1–112 up |
| | (panel 16) | Needles 113–179 down |
| | (panel 18) | Needles 180–400 up. |
| Course No. 8 | (panel 18) | Needles 1–112 up |
| | (panel 16) | Needles 113–179 (1 needle down, 1 needle up) |
| | (panel 18) | Needles 180–400 up. |

Fiber and yarn content according to the above example for both bands and body are as follows:

| | |
|---|---|
| Feed Nos. 2 and 4 | Lycra brand spandex AC 20/40den/34fil |
| Feed Nos. 1 and 3 | 70den/34fil nylon |

The blank 10 can also be made with a body 13 knitted of cotton yarn, for example, 80 singles cotton yarn, with the same Lycra/nylon content for the bands. Machines with diameters of 3¾ inches to 4¼ inches may be used, and other gauges, such as 288 needles.

A foot cover blank, foot cover and method are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A method of forming a knitted foot cover, comprising:

(a) forming a seamless knitted tube having first and second opposed tubular band portions on opposite ends thereofknitted with at least some elastic yarns, and an intermediate tubular body portion integrally-formed with said band portions, said body portion having a first panel extending along the length of said body portion between the first and second band portions having a first predetermined relatively high tension, and said body portion having a second panel extending along the length of said body portion between the first and second band portions having a second predetermined relatively low tension, the relatively different tensions of the first panel and said second panel forming said tube into a curved shape along its longitudinal axis;

(b) cutting through the first panel and the first and second band portions of the tube along a relatively straight cut line between the first and second band portions to form respective first and second free ends on each of the two band portions;

(c) joining the first free end of the first band portion and an adjacent length of the first panel to the first free end of the second band and an opposing adjacent length of the first panel; and (d) joining the second free end of the second band portion and an adjacent length of the panel to the second free end of the second band and an opposing adjacent length of the first panel to form a foot cover having an elongated shape for being fitted on and hugging only the lower portion of the foot with the joined first and second bands positioned on the asymmetrical portion of the foot below the ankle.

2. A method according to claim 1, wherein said first panel comprises between 10 and 30 percent of the circumference of the knitted tube.

3. A method according to claim 1 or 2, wherein said knitted tube is knitted of synthetic yarns.

4. A method according to claim 1 or 2, wherein the body portion of said knitted tube is knitted of cotton yarns and the first and second band portions are knitted of elastic yarns.

5. A method according to claim 1 or 2, wherein the first and second band portions are knitted of elastic yarns selected from the group consisting of spandex, synthetic latex and rubber.

6. A method according to claim 1 or 2, wherein the step of knitting the tube comprises the step of knitting the tube on a circular knitting machine.

7. A method according to claim 6, wherein said the step of knitting the tube comprises the step of knitting the tube on a knitting machine having a 4 inch diameter and 400 needles.

8. A method according to claim 1 or 2, wherein the step of joining the first and second free ends comprises the step of sewing the free ends together with sewing stitches.

9. A method according to claim 1 or 2, wherein the step of the cutting through the first panel and the first and second band portions of the tube comprises cutting with a sharp blade.

10. A method according to claim 1 or 2, wherein the step of the cutting through the first panel and the first and second band portions of the tube comprises cutting with a hot wire.

11. A knitted foot cover, comprising:

(a) a tubular knitted body portion;

(b) first and second opposed band portions, each of said first and second band portions formed from a segment of respective tubular knitted band portions containing at least some elastic yarns; and (c) first and second seams closing respective edges of the first and second opposed band portions to each other to define a single band having an elongated shape adapted for being fitted in a stretched condition onto and hugging only the lower portion of the foot with the joined first and second bands positioned on the asymmetrical portion of the foot below the ankle, one of said seams extending along the top of the foot in substantial alignment with the longitudinal axis of the toes, and the other of the seams extending along the back of the heel substantially along the longitudinal axis of the Achilles tendon.

12. A knitted foot cover according to claim 11, wherein said body portion is knitted of synthetic yarns.

13. A knitted foot cover according to claim 11, wherein said body portion is knitted of cotton yarns.

14. A knitted foot cover according to claim 11, wherein said body portion has an elongation of at least 100 percent.

* * * * *